US008359891B2

(12) United States Patent
Fujimoto

(10) Patent No.: US 8,359,891 B2
(45) Date of Patent: Jan. 29, 2013

(54) PORTABLE DEVICE

(75) Inventor: Akihiro Fujimoto, Seto (JP)

(73) Assignee: OMRON Corporation, Kyoto (JP)

( * ) Notice: Subject to any disclaimer, the term of this patent is extended or adjusted under 35 U.S.C. 154(b) by 265 days.

(21) Appl. No.: 12/050,671

(22) Filed: Mar. 18, 2008

(65) Prior Publication Data

US 2008/0229794 A1 Sep. 25, 2008

(30) Foreign Application Priority Data

Mar. 21, 2007 (JP) ..... 2007-073753

(51) Int. Cl.
*A44B 15/00* (2006.01)

(52) U.S. Cl. ..... 70/459; 70/408; 70/430; 70/456 R

(58) Field of Classification Search ..... 70/395, 70/408, 414, 429, 430, 456 R, 457, 458, 459; 206/37.1–37.8; D3/207–212
See application file for complete search history.

(56) References Cited

U.S. PATENT DOCUMENTS

| | | | | |
|---|---|---|---|---|
| 2,316,655 | A * | 4/1943 | Voos | 70/456 R |
| 5,051,724 | A * | 9/1991 | Morrow et al. | 70/456 R |
| 5,561,331 | A * | 10/1996 | Suyama et al. | 70/456 R |
| 6,386,007 | B1 * | 5/2002 | Johnson et al. | 70/408 |
| 6,460,386 | B1 * | 10/2002 | Watanuki et al. | 70/456 R |
| 6,553,802 | B1 * | 4/2003 | Jacob | 70/456 R |
| 6,672,118 | B1 * | 1/2004 | Wright | 70/456 R |
| 7,098,791 | B2 * | 8/2006 | Okada | 70/456 R |
| 7,227,446 | B2 * | 6/2007 | Kumazaki et al. | 340/5.61 |
| 7,290,419 | B2 * | 11/2007 | Balko et al. | 70/456 R |
| 2005/0166650 | A1 * | 8/2005 | Shimura et al. | 70/456 R |

FOREIGN PATENT DOCUMENTS

| | | |
|---|---|---|
| JP | 9209624 A | 8/1997 |
| JP | 2004-225350 | 8/2004 |
| JP | 2007032123 A | 2/2007 |

OTHER PUBLICATIONS

Office Action for Japanese Application No. 2007-073753 drafted Nov. 18, 2011, with English translation thereof (4 pages).
espacenet, Patent Abstract for Japanese Publication No. 9209624 Published Aug. 12, 1997 (1 page).
espacenet, Patent Abstract for Japanese Publication No. 2007032123 Published Feb. 8, 2007 (1 page).

* cited by examiner

*Primary Examiner* — Christopher Boswell
(74) *Attorney, Agent, or Firm* — Osha Liang LLP

(57) ABSTRACT

A mechanical key is to be prevented from coming apart, a head portion of the mechanical key is to be attached to a main body for use and the main body is to be prevented from being disassembled unintentionally when using the mechanical key. In a key lock structure of a mechanical key of a portable device in which a mechanical key is storable in a main body, the main body is configured in a two-piece structure including a first case and a second case, the first case includes a first storage section for storing the mechanical key and a second storage section for storing a key lock mechanism of the mechanical key, the lock mechanism locks the mechanical key stored in the first storage section to prevent the mechanical key from coming off and unlocks in response to a predetermined operation to allow the mechanical key to be pulled out.

5 Claims, 14 Drawing Sheets

PORTABLE DEVICE

BACKGROUND OF THE INVENTION

1. Field of the Invention

The present invention relates to a portable device. More specifically, for example, to a portable device used as a remote control device in a remote keyless entry system for automotive vehicles or the like.

2. Description of Related Art

A remote keyless entry system is a convenient system which allows users to lock and unlock doors only by operating a push button of a small portable device without using a mechanical key. As an advanced type, there is a system which does not require the push button operation with the portable device. With the advanced type system, the user is able to lock and unlock the door by pushing an entry button on the vehicle door or to start engine by pushing a starter button on a dash board in a state of carrying the portable device with him/her, and it is not necessary to take the portable device out from the pocket every time.

The buttery of the portable device of this type may be run out after long time of use, and hence a mechanical key (also referred to as an emergency key) is integrated in the portable device to be used in case of emergency (see JP-A-2004-225350 (Patent Document 1), for example).

<First Related Art>

FIGS. 13A to 13C are drawings illustrating a mechanical-key-integrated portable device. FIG. 13A illustrates a portable device 1 in a state in which a main body 2 and a mechanical key 3 are integrated. Hereinafter, the portable device 1 is referred to as "integrated". The integrated portable device 1 has an advantage that the mechanical key 3 is user-friendly because it is operated by holding the main body 2 with the hand. However, since the mechanical key 3, which is not normally used, is sticking out from the main body 2, it is a hindrance and the size (specially, the entire length) of the portable device 1 is disadvantageously increased.

<Second Related Art>

As an improved type, for example, as shown in FIG. 13B, a type in which a mechanical key 6 is stored in the interior of a main body 5 of a portable device 4 is conceivable. This is referred to as "stored-type". A structure in which a head portion Ca of the mechanical key 6 pulled out from the main body 5 of the portable device 4 is preferably attachable to the main body 5. In this configuration, the mechanical key 6 is also user-friendly because it is operated by holding the main body 5 with the hand as in the case of the integrated portable device 1 described above and, in addition, when the mechanical key 6 is not necessary, the mechanical key 6 may be stored in the main body 5, so that the size of the portable device 4 is not increased.

The main body 5 of the portable device 4 has a two-piece structure including an upper case 5*a* and a lower case 5*b* as shown in FIG. 13C. In addition, it has a structure in which the upper case 5*a* and the lower case 5*b* are separable (for example, a fitting type) considering battery replacement.

Formed between the upper case Ma and the lower case 5*b* is a storage section 5*c* for storing the mechanical key 6. For example, when the mechanical key 6 is used to start an engine, the user follows a procedure including steps of:

(1) pulling out the mechanical key 6 from the storage section 5*c* of the main body 5

(2) attaching the head portion 6*a* of the mechanical key 6 to the storage section 5*c*, (3) holding the body 5 with the hand, (4) inserting the mechanical key 6 into a keyhole for starting the engine, and (5) turning the main body 5 with a required force.

<Third Related Art>

FIG. 14 is a drawing illustrating another example of the stored type. In this drawing, a portable device 7 is the same as the portable device 4 described above (second related art) in that a main body 8 includes an upper case 8*a* and a lower case 8*b* of a two-piece type and is different in that a storage section 10 for storing a mechanical key 9 is formed only on one of the cases (the upper case 8*a* in the drawing), and in that a holding portion 11 is integrally formed at a head portion of the mechanical key 9.

A measure for preventing the mechanical key 9 attached to the storage section 10 of the main body 8 from coming off is achieved by forming a wide portion 9*a* at part of the mechanical key 9 and using friction between the wide portion 9*a* and the inner wall of the storage section 10.

However, in the second related art, when an excessive force is applied to the portion of the main body 5 where the mechanical key 6 is mounted (the entry portion of the storage section 5*c*) in the procedure (5), the upper case 5*a* and the lower case 5*b* may disadvantageously come apart (disassembled) unintentionally.

In the third related art, since the storage section 10 for storing the mechanical key 9 is formed only in one of the cases (the upper case 8*a* in the drawing), the problem in the portable device 4 in the second related art (unintentional disassembly of the case 8) does not occur. However, when the mechanical key 9 is removed from the main body 8, the main body 8 is separated from the mechanical key 9, and hence there arises a problem that the main body 8 or the mechanical key 9 may be lost.

In addition, in the third related art, the measure for preventing the mechanical key 9 from coming off is achieved by friction between the wide portion 9*a* of the mechanical key 9 and the inner wall of the storage section 10, the friction is gradually reduced with repeated operation of insertion and pulling off of the mechanical key 9, so that the mechanical key 9 may disadvantageously come off easily.

SUMMARY OF THE INVENTION

Accordingly, it is an object of the present invention to provide a portable device in which storage section of a mechanical key in a main body is ensured without causing unintentional coming off of the mechanical key from the main body, the mechanical key is used by attaching a head portion of the mechanical key to the main body as needed, and the main body is not unintentionally disassembled when using the mechanical key.

The invention according to a first aspect of the invention is a key lock structure for a mechanical key of a portable device in which the mechanical key is storable in a main body, in which the main body is a two-piece structure including a first case and a second case, the first case includes a first storage section for storing the mechanical key and a second storage section for storing a lock mechanism of the mechanical key, the first storage section and the second storage section are integrally formed in the interior of the first case in a hollow shape opened on one side of the first case, the first case is formed with an opening on the side opposite from the side which is combined with the second case, and the lock mechanism is configured to lock or unlock the mechanical key stored in the first storage section according to a predetermined operation.

The invention according to a second aspect of the invention is based on the key lock structure according to the first aspect, in which the lock mechanism includes a key lock base stored in the second storage section in a fixed state, a slide part slidably assembled onto the key lock base, a resilient member which urges the slide of the slide part in a predetermined direction, and operating means which is capable of sliding the slide part in the direction against the urging force of the resilient member, and in which the mechanical key stored in the first storage section is locked by the slide part to prevent the mechanical key from coming apart and the lock is released by the operating means.

The invention according to a third aspect of the invention is based on the key lock structure according to the second aspect, in which the mechanical key includes an engaging portion which is capable of engaging part of the slide part, and prevention of coming apart is achieved by the engagement between the engaging portion and the part of the slide part.

The invention according to a fourth aspect of the invention is based on the key lock structure according to the first aspect, in which the first storage section is adapted to be able to accept insertion of head portion of the mechanical key pulled out from the main body.

In the present invention, since the mechanical key is prevented from coming apart by the lock mechanism in the first case of the main body, storage section of the mechanical key in the main body is ensured and, in addition, unintentional coming off of the mechanical key from the main body is avoided.

When the first storage section is configured to be able to accept insertion of the head portion of the mechanical key pulled out from the main body, the mechanical key may be used by attaching the head portion of the mechanical key to the main body as needed. In addition, since the first storage section is formed in the first case, the main body is prevented from being disassembled unintentionally when using the mechanical key.

DESCRIPTION OF PREFERRED EMBODIMENTS

Figure 1:
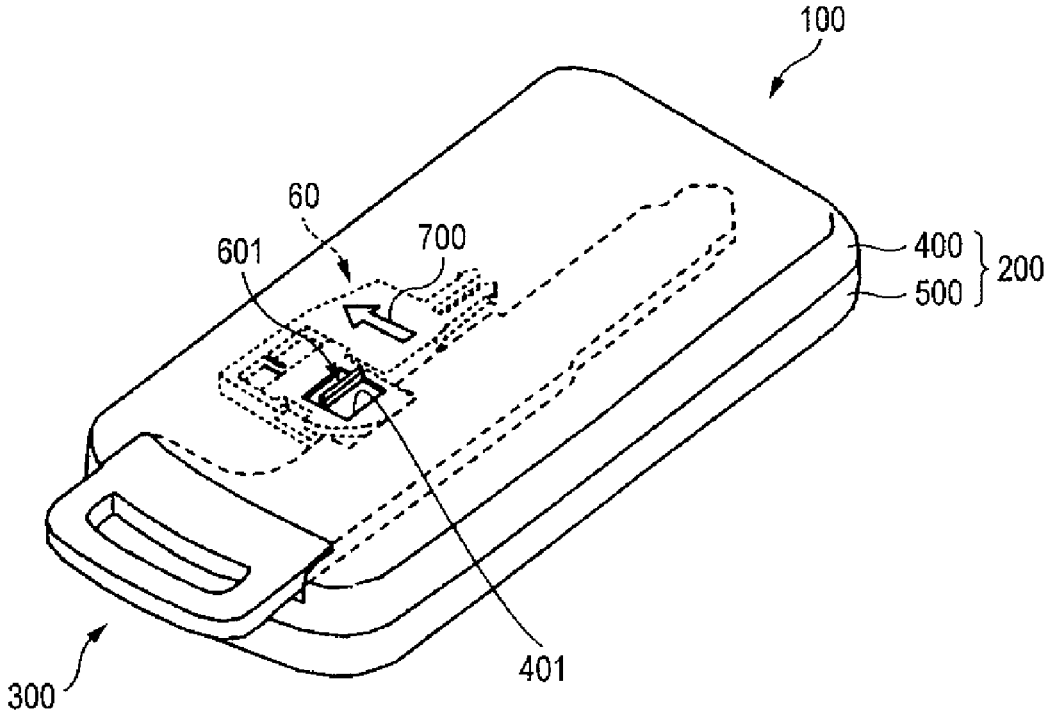
FIG. 1 is a general block diagram of a portable device 100 according to an embodiment.

Referring now to the drawings, an embodiment of the present invention will be described. Specific or actual examples of various details and examples such as numerical values, character strings and other signs in the description shown below are informative only for clarifying the idea of the present invention, and it is apparently understood that the idea of the present invention is limited thereto neither entirely nor partly. Known methods, known procedures, known architecture and known circuit structures (hereinafter, referred to as "known matters") are not described in detail. However, it is for the sake of simplification of description only, and such omission is not intended to exclude the known matters entirely or partly. These known matters are knowable by those skilled in the art at the time point of application of the present invention, and are included in the description given below as a matter of course.

FIG. 1 is a general block diagram of a portable device 100 according to the embodiment. In this drawing, the portable device 100 includes a main body 200 and a mechanical key 300 detachably stored in the main body 200.

The main body 200 includes two upper and lower cases (hereinafter, referred to as an upper case 400 and a lower case 500 according to the upper side and the lower side in the drawing) separably combined by a fitting system or other combining methods. The upper case 400 and the lower case 500 are sealed from each other by a water-proof seal or the like, so that an electronic substrate or a buttery, not shown, mounted in the interior of the tower case 500 are water-proofed.

In this manner, the lower case 500 is used as an electronic part storage section for a remote key entry system or the like. However, description of the lower case 500 is omitted since it has no direct relationship with the present invention.

The upper case 400 has two roles shown below. The first role is to serve as an "upper lid" of the lower case 500, and the second role is to serve as a "lock-mechanism-provided key storage section" for detachably storing the mechanical key 300.

The second role (the role as the "lock mechanism provided key storage section") will be described in detail. As shown in the drawing, the mechanical key 300 is stored in the interior of the upper case 400, and a key lock mechanism 600 having a plurality of components is built in the interior of the upper case 400. Although detailed description will be given later, the key lock mechanism 600 has functions of:

(a) bringing the mechanical key 300 stored in the interior of the upper case 400 in a locked state to prevent the mechanical key 300 from unintentionally coming off; and (b) unlocking the mechanical key 300 by sliding one of the components of the key lock mechanism 600 (hereinafter, referred to as a knob 601), which is projected from an opening 401 formed in an upper surface of the upper case 400, in the direction indicated by an arrow 700 for allowing the mechanical key 300 to be pulled out from the upper case 400.

The structure of the upper case 400 will be described.

Figure 2A:
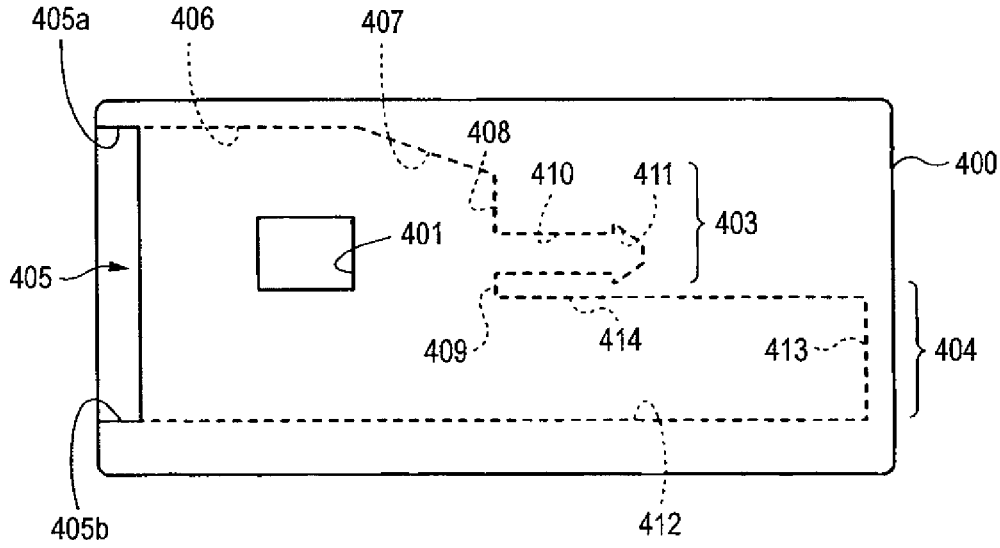
FIGS. 2A to 2C are block diagrams showing a configuration of an upper case.
Figure 2B:
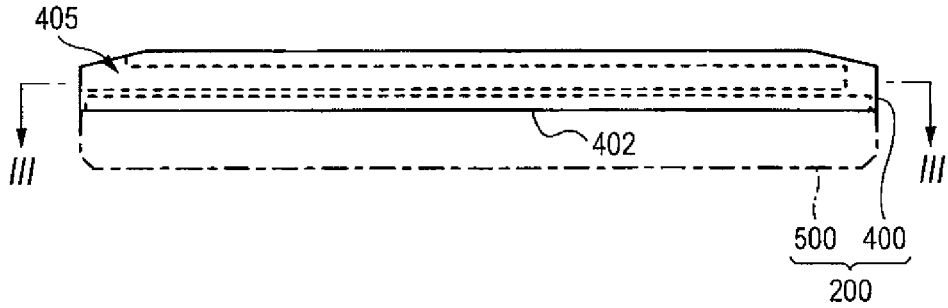
Figure 2C:
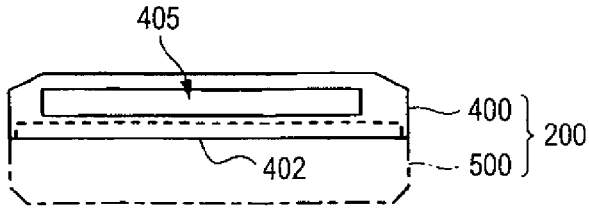

FIGS. 2A to 2C are block diagrams showing a configuration of the upper case 400, in which FIG. 2A is a plan view, FIG. 2B and FIG. 2C are side views. In these drawings, a lower surface lid of the lower case 500, and the lower surface 402 is a flat plane without opening such as a hole or the like.

Integrally defined in the interior of the upper case 400 area storage section for the key lock mechanism 600 (hereinafter, referred to as a lock mechanism storage section 403) and a storage section for the mechanical key 300 (hereinafter, referred to as a key storage section 404). These two storage sections (the lock mechanism storage section 403 and the key storage section 404) communicate with each other, and has an opening on the side of the one short side (the left side of the drawing) of the upper case 400. The opening serves as an attachment and detachment port 405 for the mechanical key 300. The attachment and detachment port 405 is also used as an insertion port of the key lock mechanism 600 when assembling the portable device 100.

The lock mechanism storage section 403 includes a first side wall 406 extending substantially linearly along one side surface 405*a* of the attachment and detachment port 405, a second side wall 407 intersecting the first side wall 406 at a predetermined obtuse angle, a third side wall 408 and a fourth side wall 409 continuing to the second side wall 407 extending substantially parallel to the attachment and detachment port 405*r* a bottomed long hole 410 having a predetermined length extending from between the third side wall 408 and the fourth side wall 409 in the longitudinal direction of the upper case 400, and a substantially triangular space 411 formed on the bottom (a far end) of the bottomed long hole 410. The "bottomed long hole" means a long hole formed in a tunnel shape, and in particular, the far end thereof is closed by a "wall". The "wall" may also be referred to as a "bottom" of the hole, it is a "long hole having a bottom" and hence is referred to as "bottomed long hole".

On the other hand, the key storage section 404 includes a first side wall 412 extending substantially linearly along the other side surface 405*b* of the attachment and detachment port 405, a second side wall 413 continuing to the first side wall 412 and extending substantially in parallel to the attachment and detachment port 405, and a third side wall 414 continuing to the second side wall 413, extending in parallel to the first side wall 412 and extending to the fourth side wall 409 of the lock mechanism storage section 403.

Figure 3:
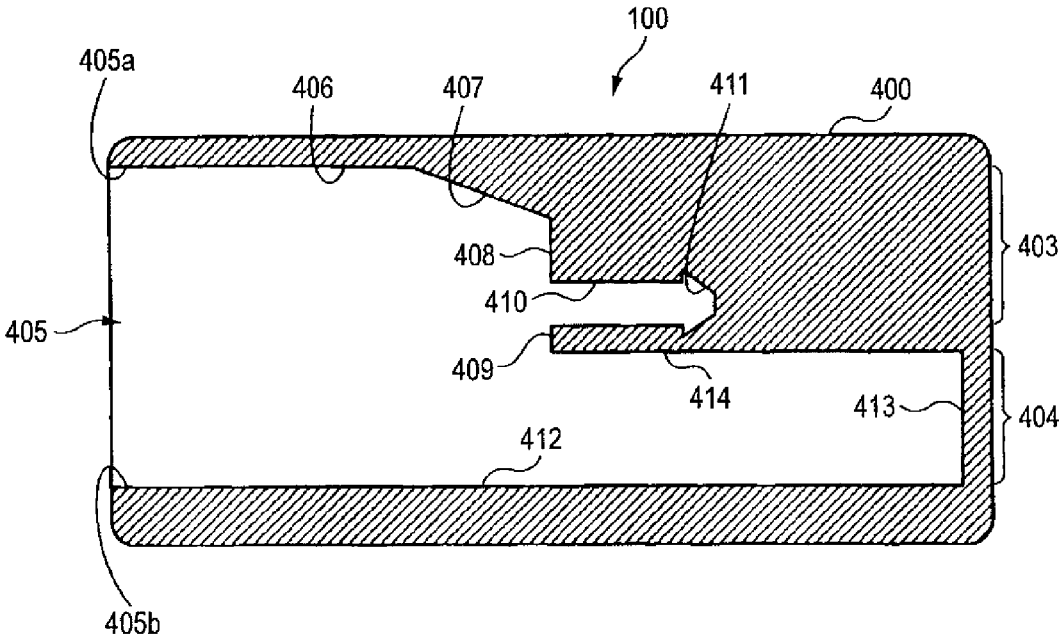
FIG. 3 is a cross-sectional view of the upper case taken along the line A-A.

FIG. 3 is a cross-sectional view of the upper case 400 taken along the line A-A (see FIG. 2B). As shown in this drawing, the upper case 400 is opened on the left side in the drawing, and the opened portion is used as the attachment and detachment port 405 of the mechanical key 300 (and also serves as the insertion port of the key lock mechanism 600), and is formed integrally with two hollow bag-shaped storage sections (the lock mechanism storage section 403 and the key storage section 404) continuing to the attachment and detachment port 405 in the interior thereof.

Subsequently, the structure of the key lock mechanism 600 will be described.

FIGS. 4A to 4F are explanatory drawings of components of the key lock mechanism 600. As shown in this drawing, the key lock mechanism 600 is composed of following four components (the knob 601, a key lock base 602, a slide part 603 and a spring 604). Hereinafter, these components are described one by one.

Figure 4A:
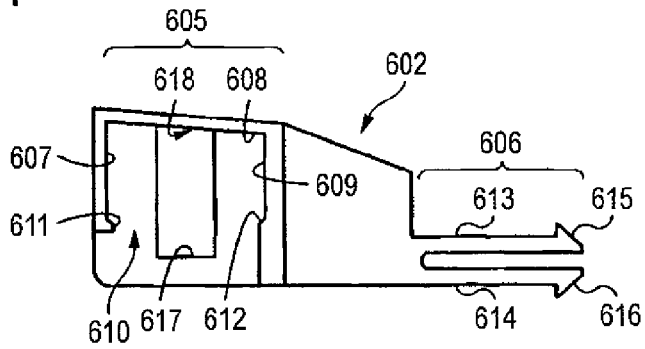
FIGS. 4A to 4F are explanatory drawings of components of a key lock mechanism.

The key lock base 602 is a component which serves as a base of the key lock mechanism 600 as shown in FIG. 4A, and the key lock base 602 includes a sliding portion 605 which guides the sliding movement of the slide part 603 and a locking portion 606 to be locked with the upper case 100. The sliding portion 605 is configured in such a manner that the slide part 603 is able to be set to a substantially rectangular-shaped plane 610 surrounded by projecting edges 607 to 609 on the upper, left and right sides in the drawing. In the set state, the slide part 603 is adapted to be slid in the vertical direction in the drawing while being guided along the left and right projecting edges 608, 609. However the downward sliding of the slide part 603 is restricted at positions of stoppers 611, 612 formed at midsections of the left and right projecting edges 608, 609.

The locking portion 606 includes a pair of long arms 613, 614 extending rightward in the drawing in substantially parallel to each other and hook portions 615, 616 formed at distal ends of the long arms 613, 164, respectively. The long arms 613, 614 of the locking portion 606 are inserted into the bottomed long hole 410 of the lock mechanism storage section 403 of the upper case 400 to the end, and the hook portions 615, 616 of the locking portion 606 are engaged with the space 411 formed at the bottom (far end) of the bottomed long hole 410, so that the key lock base 602 and the upper case 400 are integrated.

The sliding portion 605 which guides the sliding movement of the slide part 603 is formed with an opening 617 in a vertically elongated rectangular shape, and the upper side in the drawing of the opening 617 comes into contact with the projecting edge 608 at the center from among the projecting edges 607 to 609 which surround the sliding portion 605, and a projection 618 for holding the spring 604 is formed on the lower surface in the drawing of the projecting edge 608.

Figure 4B:
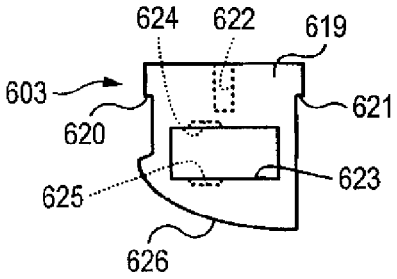
Figure 4D:
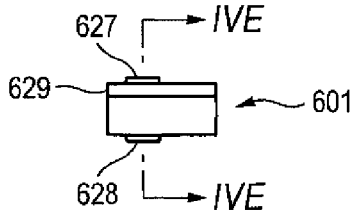
Figure 4C:
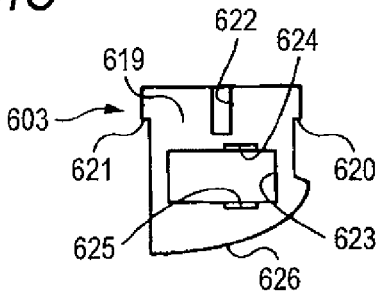

Subsequently, as shown in FIG. 4B and FIG. 4C (FIG. 4C is a drawing viewed with the slide part 603 in FIG. 4B from the reverse side), the slide part 603 is formed with stoppers 620, 621 which oppose the stoppers 611, 612 of the slide part 603 on the both left and right sides surfaces of a substantially rectangular-shaped main body 619, a spring groove 622 for holding the spring 604, a knob attaching hole 623 for attaching the knob 601, and knob fixing grooves 624, 625 for fixing the knob 601. The side of the main body 619 on the lower side in the drawing is formed into a substantially arcuate shape, and the arcuate shaped portion is utilized as a locking portion 626 for locking the mechanical key 300.

Figure 4E:
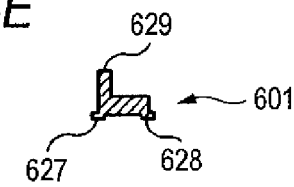
Figure 4F:
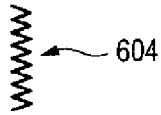

Subsequently, as shown in the drawings FIGS. 4D and 4E (FIG. 4E is a cross-sectional view taken along the line B-B in FIG. 4D), the knob 601 has a shape which is attachable to the knob attaching hole 623 of the slide part 603 as a whole and has projections 627, 628 engaged with the knob fixing grooves 624, 625 of the slide part 603 and an operating portion 629 to be operated with a finger tip or the like for unlocking when the slide part 603 is attached to the knob attaching hole 623.

Finally, the spring 604 is a minute compression spring (the compression spring or the coil spring) to be inserted into the spring groove 622 of the slide part 603 in a compressed state.

Subsequently, an assembling procedure of the key lock mechanism 600 will be described.

Figure 5:
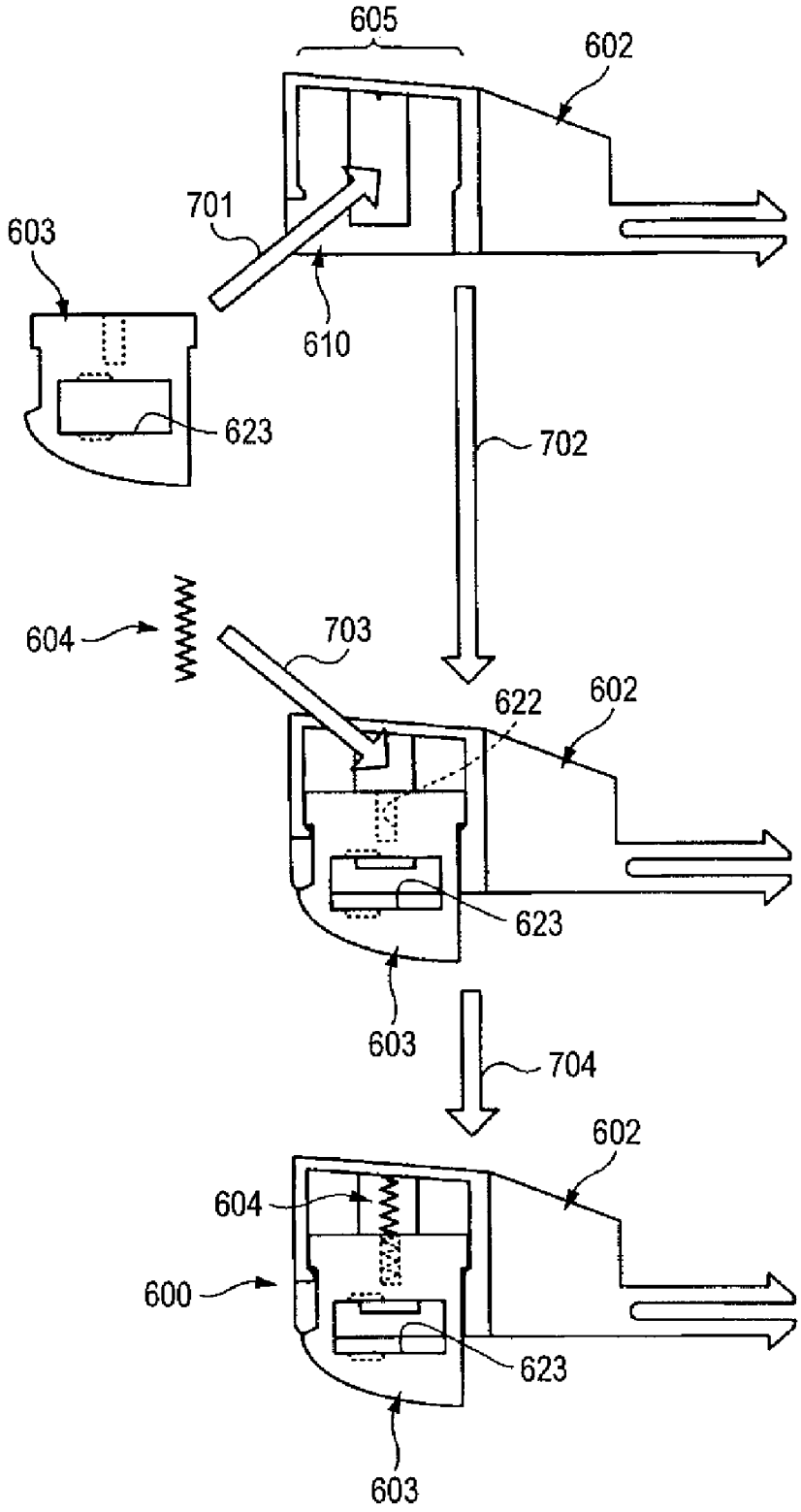
FIG. 5 is an assembly drawing of the key lock mechanism.

FIG. 5 is an assembly drawing of the key lock mechanism 600. As shown in this drawing, first of all, the slide part 603 is mounted to the sliding portion 605 of the key lock base 602 in a sliding movement (see an arrow 701), then, the spring 604 is inserted into the spring groove 622 of the slide part 603 (see arrows 702, 703), so that the key lock mechanism 600 composed of the three components (the key lock base 602, the slide part 603 and the spring 604) except for the knob 601 is assembled (see an arrow 704).

Figure 6:
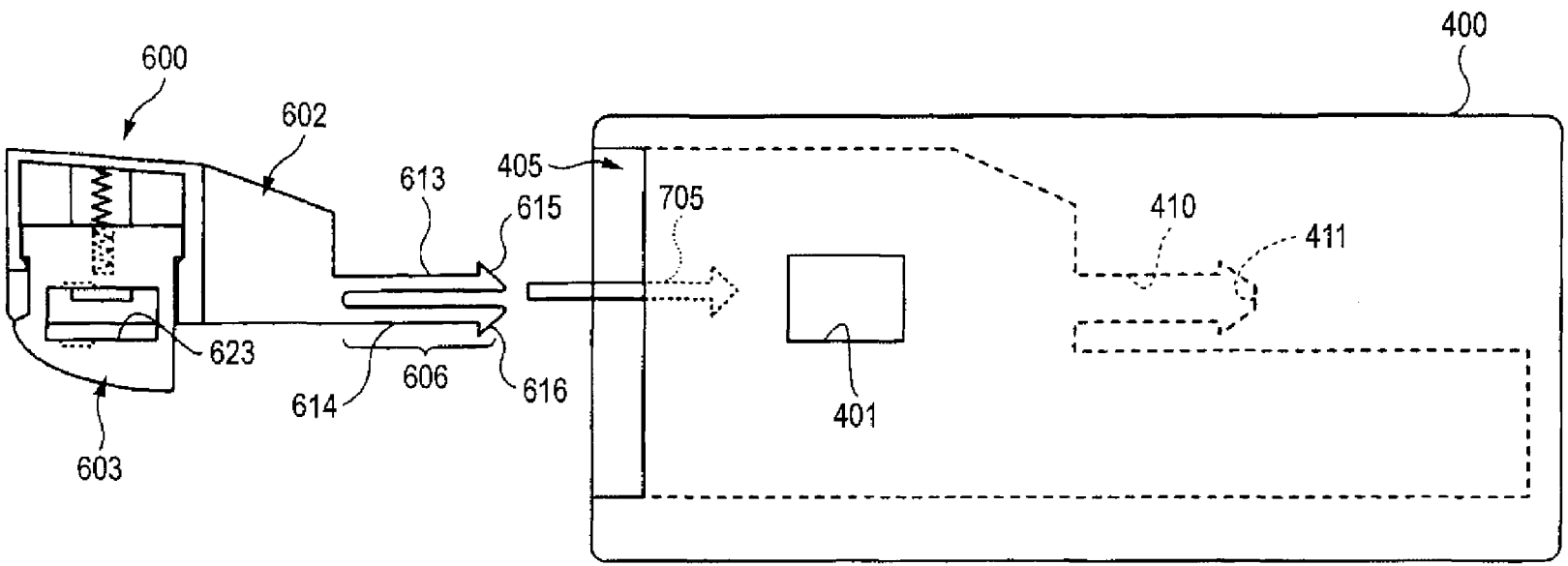
FIG. 6 is a drawing illustrating a procedure to insert the key lock mechanism into the upper case.
Figure 7:
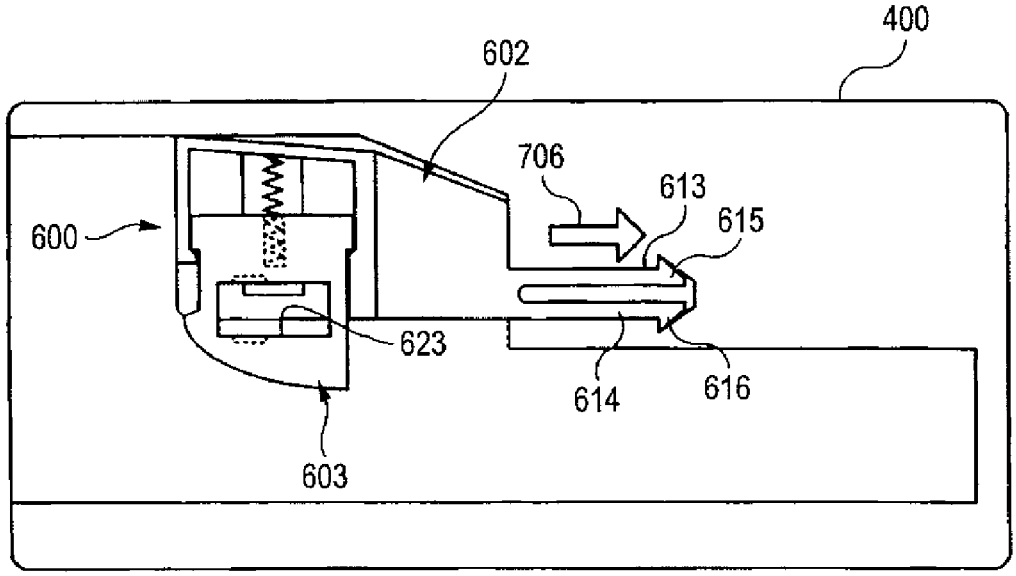
FIG. 7 is a drawing illustrating a state in which the insertion of the key lock mechanism is completed.
Figure 8:
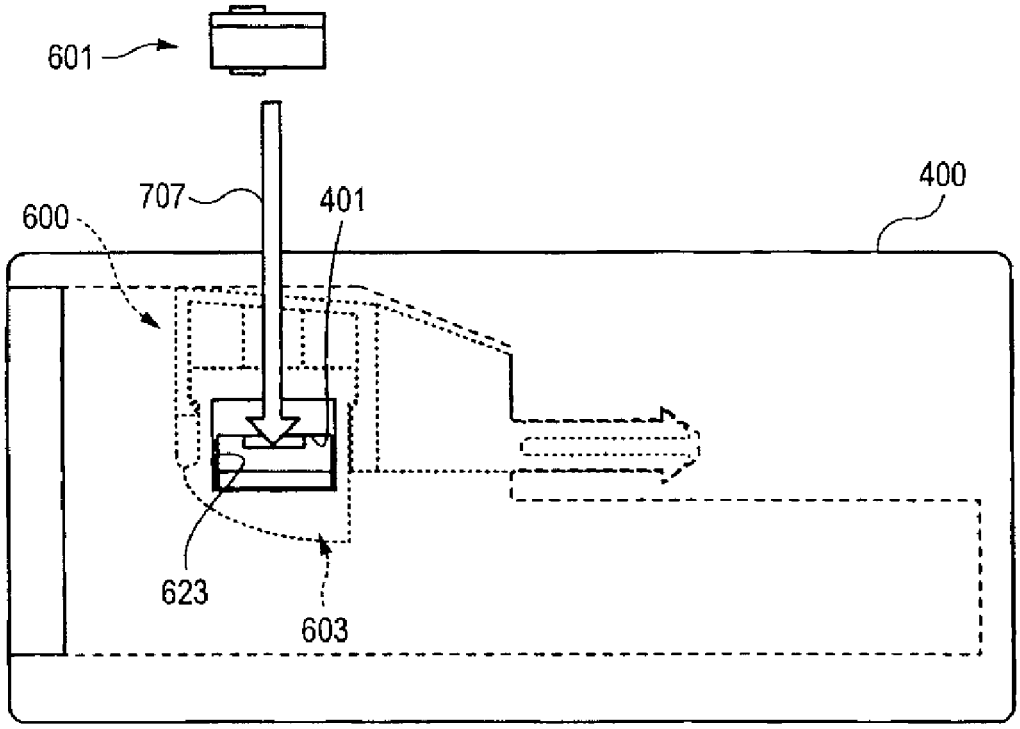
FIG. 8 is a drawing illustrating a state in which the rest of the component (knob) of the key lock mechanism is assembled.

FIG. 6 is a drawing illustrating a procedure to insert the key lock mechanism 600 assembled in the manner shown in FIG. 5 into the upper case 400, FIG. 7 is a drawing illustrating a state in which the insertion of the key lock mechanism 600 is completed (a cross-sectional view which is similar to FIG. 3), and FIG. 8 is a drawing illustrating a state in which the rest of the component (the knob 601) of the key lock mechanism 600 is assembled.

As shown in these drawings, the key lock mechanism 600 is inserted from the attachment and detachment port 405 of the upper case 400 along an arrow 705 and the long arms 613, 614 of the key lock mechanism 600 are pushed into the bottomed long hole 410 of the upper case 400 by applying a required force in the direction indicated by an arrow 706, whereby the hook portions 615, 616 at the distal ends of the long arms 613, 614 are inserted into the space 411 of the upper case 400 and fixed thereto (see FIG. 6 and FIG. 7). Then, in this state, the knob 601 is inserted from the opening 401 of the upper case 400 (see an arrow 707 in FIG. 8) and the knob 601 is attached to the knob attaching hole 623 of the slide part 603 to complete the attachment of the key lock mechanism 600 to the upper case 400. When attaching the knob 601 to the knob attaching hole 623 of the slide part 603, it is necessary to press the knob 601 from above with a relatively strong force so as to fit the projections 627, 628 of the knob 601 into the knob fixing grooves 624, 625 of the slide part 603, respectively.

Figure 9:
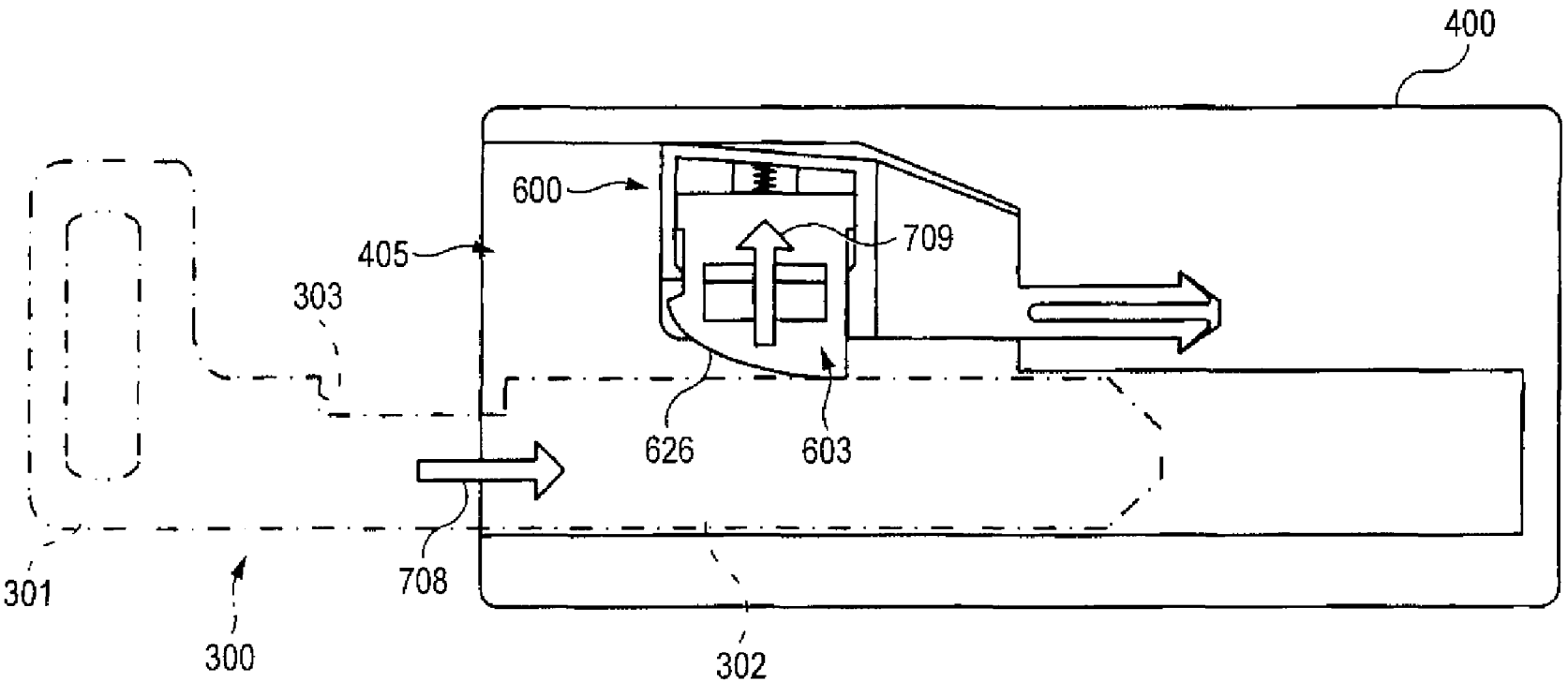
FIG. 9 is a drawing illustrating a procedure to insert a mechanical key into the upper case.
Figure 10:
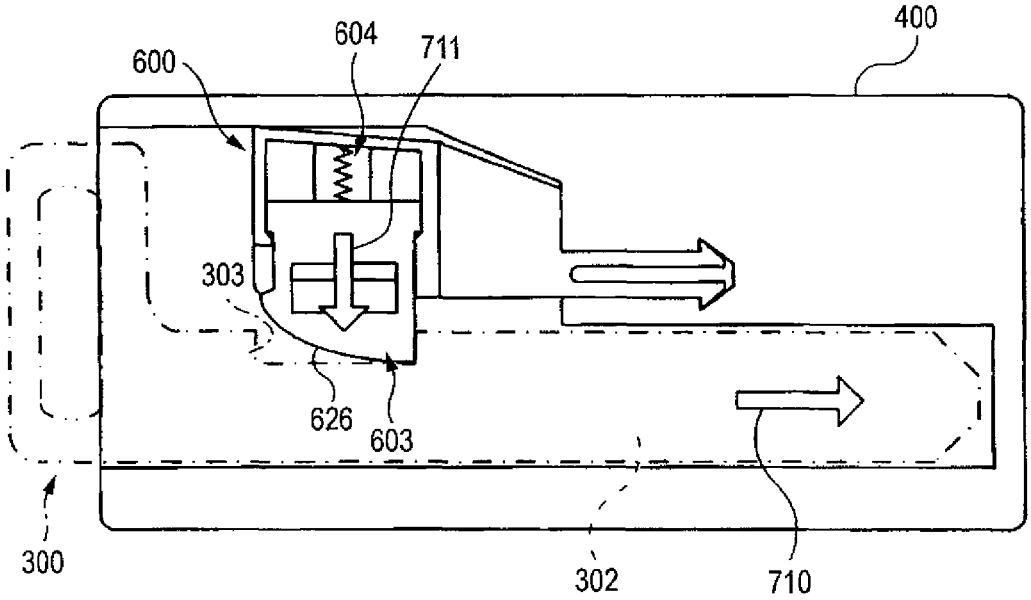
FIG. 10 is a drawing illustrating a state in which insertion of the mechanical key is completed.

FIG. 9 is a drawing illustrating a procedure to insert the mechanical key 300 into the upper case 400 (a cross-sectional view which is similar to FIG. 3), and FIG. 10 is a drawing illustrating a state in which insertion of the mechanical key 300 is completed (a cross-sectional view which is similar to FIG. 3).

The mechanical key 300 is integrally formed with a head portion 301, a key portion 302 continuing from the head portion 301 and having a predetermined length, and a depression 303 formed on the key portion 302 in the vicinity of the head portion 301 for locking the key with metallic material or the like.

In a stage of inserting the mechanical key 300 into the upper case 400 (see an arrow 708 in FIG. 9), since the lock portion 626 of the slide part 603 of the key lock mechanism 600 is pushed upward in the drawing (see an arrow 709 in FIG. 9) by the key portion 302 of the mechanical key 300, the depression 303 of the mechanical key 300 does not engage the lock portion 626 of the slide part 603 of the key lock mechanism 600.

When the mechanical key 300 is inserted to the end (see an arrow 710 in FIG. 10), the lock portion 626 of the slide part 603 of the key lock mechanism 600 falls into the depression 303 of the mechanical key 300 (see an arrow 711 in FIG. 10), and the depression 303 of the mechanical key 300 engages the lock portion 626 of the slide part 603 of the key lock mechanism 600, so that the mechanical key 300 is brought into a locked state. The locked state is maintained from then on as well by an urging force of the spring 604, and hence the mechanical key 300 does not come apart.

Figure 11:
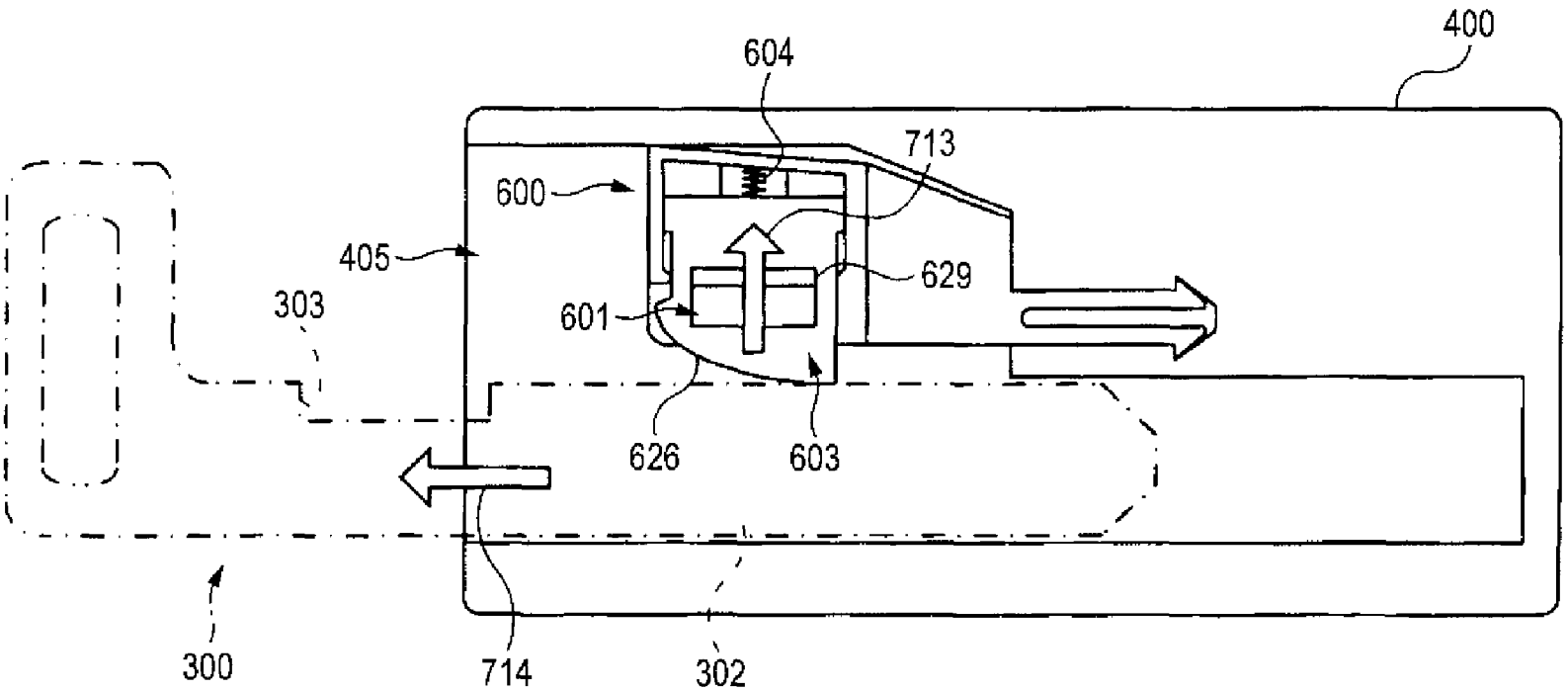
FIG. 11 is a drawing illustrating a procedure of unlocking.

Subsequently, unlocking of the mechanical key 300 by manual operation will be described FIG. 11 is a drawing illustrating a procedure of unlocking (a cross-sectional view which is similar to FIG. 3). As shown in this drawing, when the operating unit 629 of the knob 601 is operated with a fingertip or the like and is slid upward in the drawing (see an arrow 713 in the drawing), the spring 604 is deformed by compression, and the slide part 603 of the key lock mechanism 600 is moved in the same direction, so that the engagement between the lock portion 626 of the slide part 603 of the key lock mechanism 600 and the depression 303 of the mechanical key 300 is released. Therefore, the mechanical key 300 is able to be pulled out from the upper case 400 (see an arrow 714).

The mechanical key 300 pulled out from the upper case 400 in this manner is able to be used independently as a matter of course, and may also be used by setting the head portion 301 of the mechanical key 300 to the attachment and detachment port 405 of the upper case 400 as in the second related art described at the beginning.

Figure 12:
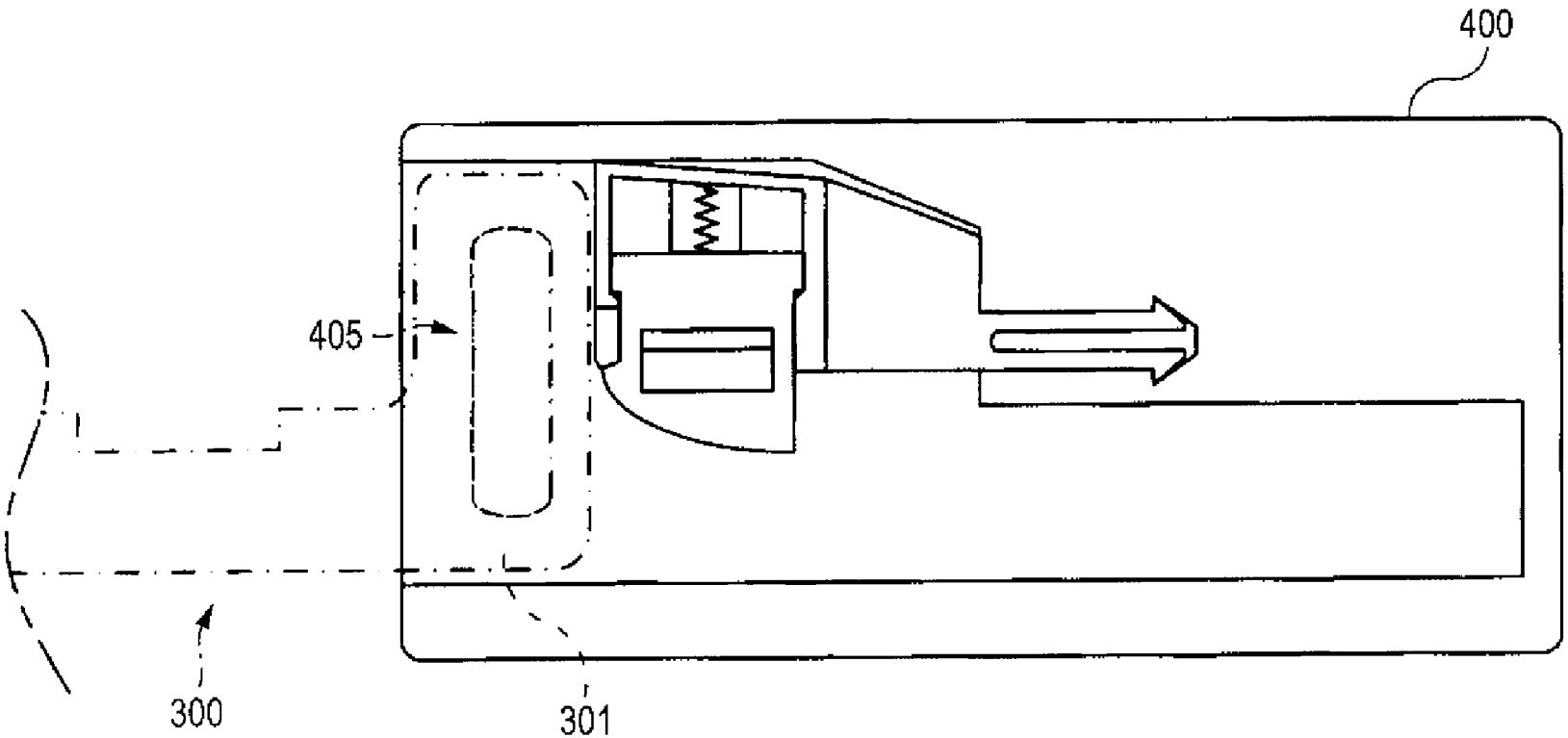
FIG. 12 is a drawing illustrating a procedure of setting a head portion of the pulled out mechanical key into an attachment and detachment port of the upper case for use.
Figure 13A:
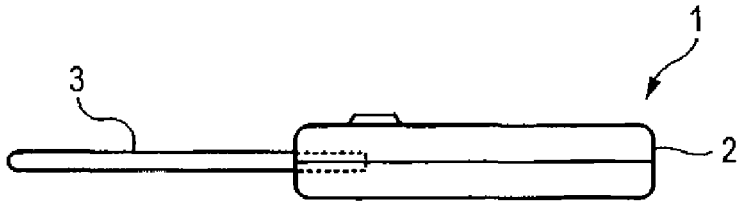
FIGS. 13A to 13C are drawings illustrating first and second related arts.
Figure 13B:
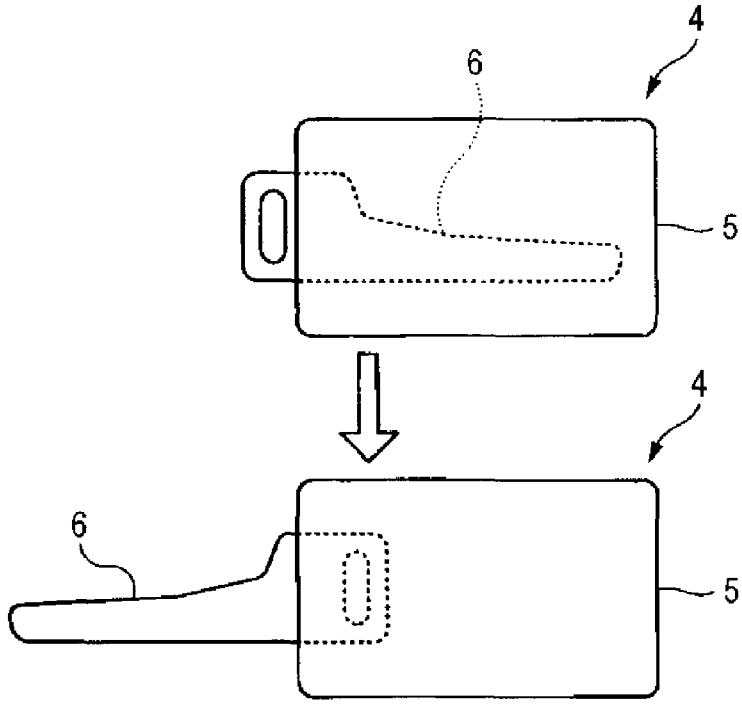
Figure 13C:
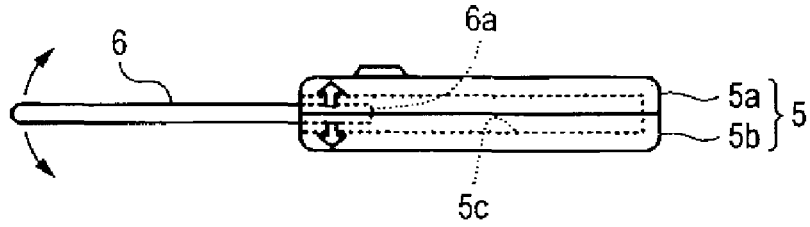
Figure 14:
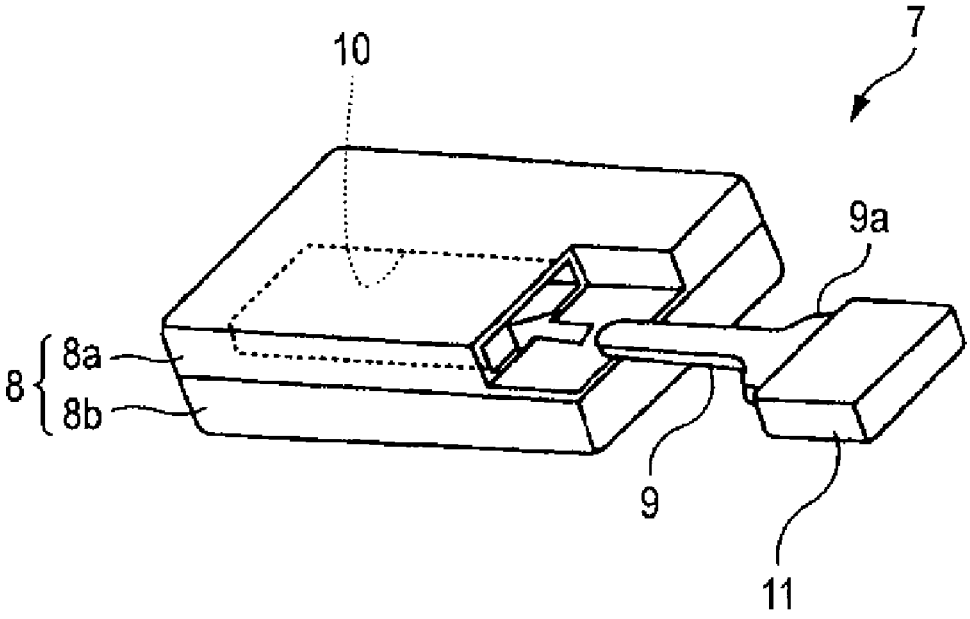
FIG. 14 is a drawing illustrating a third related art.

FIG. 12 is a drawing illustrating a procedure of setting the head portion 301 of the pulled out mechanical key 300 into the attachment and detachment port 405 of the upper case 400 for use (a cross-sectional view which is similar to FIG. 3). As shown in this drawing, it is also possible to invert the mechanical key 300 pulled out from the upper case 400, set the head portion 301 to the attachment and detachment port 405 of the upper case 400, and hold the upper case 400 to operate the mechanical key 300 if necessary.

In this configuration, the portable device 100 of this embodiment achieves the following advantages.

(a) When the mechanical key 300 is stored in the main body 200, the mechanical key 300 is locked by the key lock mechanism 600. Therefore, the mechanical key 300 is prevented from coming apart unintentionally.

(b) By sliding the operating unit 629 of the knob 601 with a fingertip or the like, the mechanical key 300 is able to be pulled out from the main body 200 by one-touch operation.

(c) The mechanical key 300 may be used in a state in which the head portion 301 of the pulled out mechanical key 300 is inserted into the attachment and detachment port 405 of the main body 200 by holding the main body 200 with hand. In this case, since the head portion 301 of the mechanical key 300 is inserted into the attachment and detachment port 405 formed on one side (upper case 400) of the main body 200, the upper case 400 and the lower case 500 are prevented from separating unintentionally by a force associated with the usage of the mechanical key 300.

What is claimed is:

1. A key lock structure for a mechanical key of a portable device in which the mechanical key is storable in a main body, wherein the main body is a two-piece structure including a first case and a second case, wherein the first case includes a first storage section for storing the mechanical key and a second storage section for storing a lock mechanism of the mechanical key, wherein the first storage section and the second storage section are integrally formed in the interior of the first case in a hollow shape opened on one side of the first case, wherein the first case is formed with an opening on the side opposite from the side which is combined with the second case, wherein the lock mechanism is configured to lock or unlock the mechanical key stored in the first storage section according to a predetermined operation;

wherein the second storage section comprises a substantially triangular bottomed long hole designed to accommodate a locking portion of the lock mechanism;

wherein the locking portion of the lock mechanism comprises a pair of long arms extending substantially parallel to each other and an insertion direction of the mechanical key; and wherein a hook portion is formed at the distal ends of each of the long arms to engage the substantially triangular bottomed long hole.

2. The key lock structure according to claim 1, wherein the lock mechanism comprises: a key lock base stored in the second storage section in a fixed state; a slide part slidably assembled onto the key lock base; a resilient member which urges the slide of the slide part in a predetermined direction; and operating means which is capable of sliding the slide part in the direction against the urging force of the resilient member, and wherein the mechanical key stored in the first storage section is locked by the slide part to prevent the mechanical key from coming apart and the lock is released by the operating means.

3. The key lock structure according to claim 2, wherein the mechanical key includes an engaging portion which is capable of engaging part of the slide part, and prevention of coming apart is achieved by the engagement between the engaging portion and the part of the slide part.

4. The key lock structure according to claim 1, wherein the first storage section is adapted to be able to accept insertion of head portion of the mechanical key pulled out from the main body.

5. A method for assembling a key lock structure for a mechanical key of a portable device in which the mechanical key is storable in a main body, the method comprising:

assembling a locking mechanism;

wherein the lock mechanism comprises:

a key lock base stored in a second storage section in a fixed state;

a slide part slidably assembled onto the key lock base;

a resilient member which urges the slide of the slide part in a predetermined direction;

a locking portion comprising a pair of a pair of long arms extending substantially parallel to each other and an insertion direction of the mechanical key;

wherein a hook portion is formed at the distal ends of each of the long arms to engage a substantially triangular bottomed long hole;

operating means which is capable of sliding the slide part in the direction against the urging force of the resilient member;

wherein the second storage section comprises the substantially triangular bottomed long hole designed to accommodate the locking portion of the lock mechanism;

inserting the lock mechanism into the second storage section of a first case of a main body;

wherein the main body is a two-piece structure including the first case and a second case;

wherein the first case includes a first storage section for storing the mechanical key and the second storage section for storing a lock mechanism of the mechanical key;

wherein the first storage section and the second storage section are integrally formed in the interior of the first case in a hollow shape opened on one side of the first case;

wherein the first case is formed with an opening on the side opposite from the side which is combined with the second case;

wherein the lock mechanism engages the substantially triangular bottomed long hole;

inserting the mechanical key;

wherein the mechanical key stored in the first storage section is locked by the slide part to prevent the mechanical key from coming apart and the lock is released by the operating means.

* * * * *